US005496005A

United States Patent [19]

Dieringer

[11] Patent Number: 5,496,005

[45] Date of Patent: Mar. 5, 1996

[54] HANGER FOR ELECTRICAL CONDUITS

[76] Inventor: Dale E. Dieringer, 5195 W. 58th Ave., Ste. 300, Arvada, Colo. 80002

[21] Appl. No.: 193,429

[22] Filed: Feb. 8, 1994

[51] Int. Cl.[6] ..... F21V 21/00

[52] U.S. Cl. ..... 248/74.2; 248/911; 248/316.7; 248/71; 248/48.1; 362/249

[58] Field of Search ..... 248/74.2, 73, 71, 248/48.1, 48.2, 205.1, 217.3, 218.2, 231.9, 231.91, 316.7, 911; 362/249, 391, 396; 24/543, 336

[56] References Cited

U.S. PATENT DOCUMENTS

| | | | |
|---|---|---|---|
| 3,193,229 | 7/1965 | Stock | 362/396 X |
| 3,599,916 | 8/1971 | Szabo | 248/73 |
| 3,883,926 | 5/1975 | Reynolds | 248/238 X |
| 4,707,906 | 11/1987 | Posey | 248/74.2 X |
| 4,811,475 | 3/1989 | Morton, Jr. | 248/339 X |
| 4,905,131 | 2/1990 | Gary | 362/249 |
| 4,974,128 | 11/1990 | Prickett | 362/396 X |
| 5,056,747 | 10/1991 | Kireta | 248/74.2 X |
| 5,249,108 | 9/1993 | Gary | 248/316.7 X |
| 5,388,802 | 2/1995 | Dougan et al. | 248/231.2 X |

*Primary Examiner*—Karen J. Chotkowski
*Attorney, Agent, or Firm*—Richard W. Hanes

[57] ABSTRACT

A hanger for supporting decorative electric wiring from a building structure, comprising an elongated base member having a spatulate like projecting blade containing top and bottom surfaces which are serrated, a strap attached to and depending from the bottom surface of the base member, and a clamp carried by the depending strap and having springable jaws for securely holding at least one electrical conductor.

9 Claims, 1 Drawing Sheet

HANGER FOR ELECTRICAL CONDUITS

The present invention relates to an article of manufacture for temporarily hanging electrical conduits from the edges of building roofs.

BACKGROUND OF THE INVENTION

Apparatus for installing and displaying exterior decorative lighting on and around building roof structures has been the subject of some earlier patents. U.S. Pat. Nos. 4,851,977 and 4,905,131 for *Brackets For Decorative Lighting* are examples. Both of these patents disclose a base member for insertion between adjacent or overlapping layers of building material, such as roofing shingles or decking, and a bracket, attached to or integral with the base member, which supports the base socket or bulb portion of an incandescent light.

While the basic purpose of the present invention is somewhat similar to that of the stated prior art, the article of the present invention constitutes an improvement in several areas. First, the prior art devices provide no means for conveniently attaching a string of lights to a roof's edge where a typical rain gutter is installed. To do so would bury the lighting in the rain gutter. Second, installing each light bulb into a bracket by extracting the bulb from its socket, inserting the bulb or socket into the aperture in the bracket and then reinstalling the bulb in the socket is laborious and time consuming. Third, the use of the bulbs themselves as means for mounting multiplies the risk of breaking the bulbs during installation.

It is therefore the primary object of the present invention to provide a decorative light string hanger device which can be inserted between layers of roofing material or, with other structural constraints, mounted directly to the outside perimetrical edge of a rain gutter.

A second object of the invention is to provide a decorative light string holder which supports the light string by griping the insulated electrical conductors therein rather than to directly attach to the light bulbs or bulb sockets in the string.

Another object of the present invention is to provide a unitary light string mounting structure which is inexpensive to manufacture and easy to install and which will provide maximum safety.

Other and further objects, features and advantages of the present invention will become apparent upon a reading of the following detailed description of a preferred form of the invention, taken in conjunction with the attached drawings.

DETAILED DESCRIPTION

Figure 1:
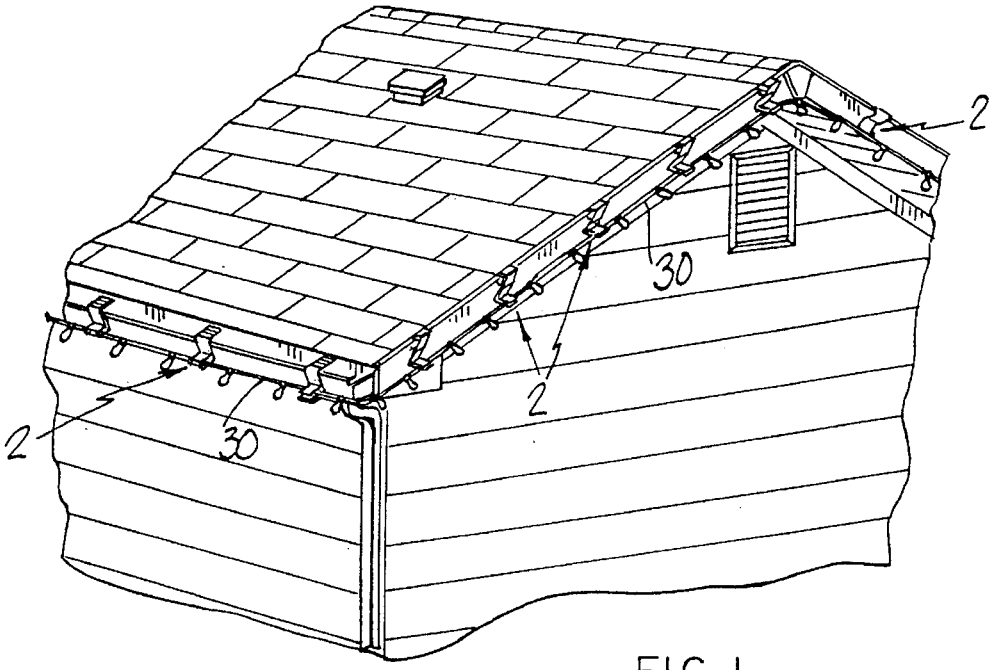
FIG. 1 is a fragmentary perspective view of a typical roof structure showing several of the hangers of the present invention supporting a string of decorative lights.
Figure 2:
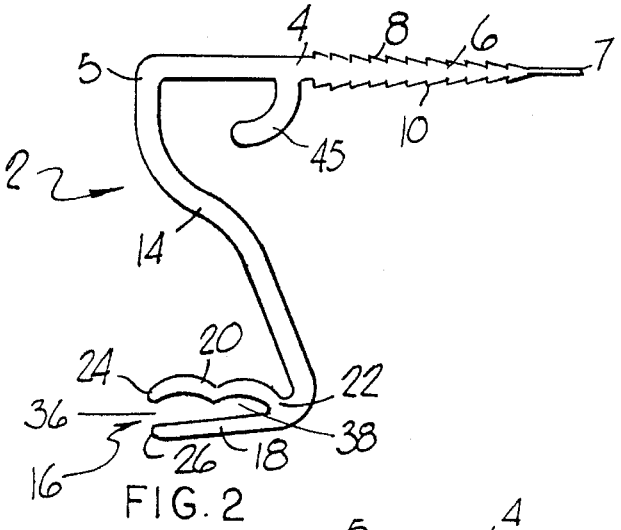
FIG. 2 is a side view of the hanger of the present invention.
Figure 3:
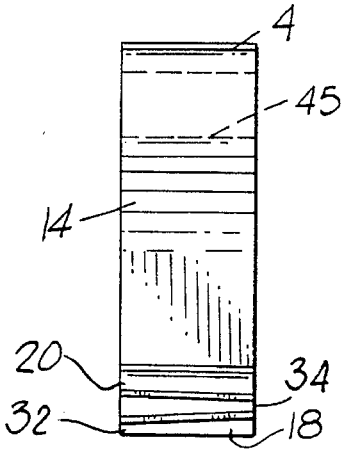
FIG. 3 is a rear view.

The hanger 2 of the present invention is preferably a unitary structure of plastic material, as seen in the perspective view of FIG. 1. An elongated base member 4 having first and second ends, 5 and 7, comprises a rigid spatulate like blade 6 having a series of serrations or pointed notches 8 in the upper surface and a similar series of serrations 10 in the lower surface of the blade 6. When the light string is to be hung from the edge of a typical roof covered with overlapping composition or wooden shingles, the hanger 2 can be quickly attached to the roofing material by inserting the blade 6 between adjacent shingles or between a shingle and the underlying base or roof sheeting. In either case the serrations 8 and 10, which are pointed toward the rear, or first end 5, of the hanger will produce sufficient friction to maintain the hanger in its inserted position between the roofing elements until it is forcibly removed.

Depending from the rear, or first end 5, of the base member 4 is a rigid strap 14 which carries at its lower end a clamping device 16, intended to grip the insulated electrical conductors comprising the string of decorative lights. The length of the strap 14 is not critical, however the length of the strap will provide a lever arm and a resulting force moment to place upward pressure on the base member blade 6 to enhance its gripping action on the roofing members between which it is inserted.

Preferably, the clamping device 16 is merely the bifurcated bent end of the strap 14. The lower jaw 18 of the clamp extends rearwardly from the depending strap in a position approximately parallel to the base member 4. A second jaw 20, having two ends 22 and 24, is integrally joined at one of its ends to the depending strap, forming the closed end of the clamping device 16. The other end 24 of the second jaw is spaced apart from the free end 26 of the lower jaw 18, providing an opening for the insertion into the clamping device of the insulated electrical conducting wires 30 of the light string. The jaws 18 and 20 of the clamping device are arranged or molded so that the spacing between the lower and the upper jaw is greater on one side 32 of the clamp 16 than it is on the other side 34 of the clamp. This dissimilar spacing of the jaws provides a means for increasing the griping and locking ability of the clamping device on the wires 30 to prevent them from moving back and forth longitudinally in the clamp. In order to accommodate wires of different sizes the jaws 18 and 20 of the clamp are scalloped from front to rear, that is from the closed end to the open end of the clamping jaws. In the preferred form of the invention there are two scallops, providing two differently sized tubular openings 36 and 38 for two differently sized wires.

Figure 4:
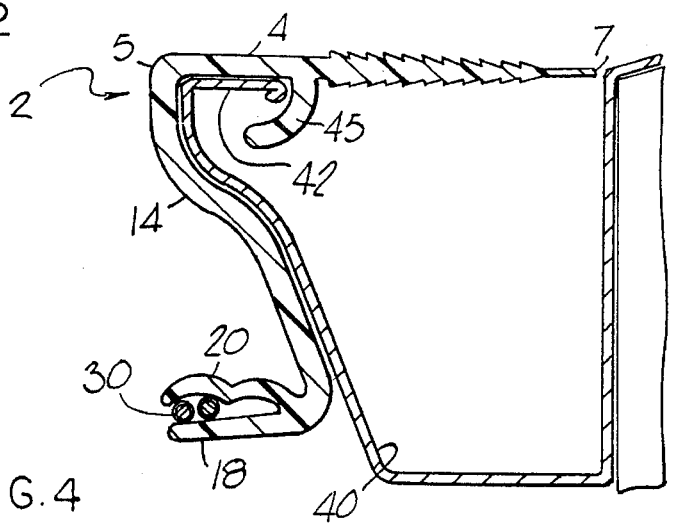
FIG. 4 is a cross sectional view of the hanger of the present invention and a cross sectional view of a rain gutter, showing the interconnection between the hanger and the rain gutter for mounting the decorative lights to the rain gutter.

Frequently, the roof on whose edges it is desired to hang decorative lighting strings is equipped with a rain gutter 40, as seen in FIG. 4. The presence of a rain gutter interferes with the mounting of decorative lighting, as described above with reference to inserting the serrated blade 6 of the base member between layers of roofing materials. In such a situation, the lighting string must be hung from the exterior edge of the gutter structure in order that the lights may be clearly seen. The article of the present invention easily accommodates this alternative. To enhance the structural rigidity of the elongate gutter, usually made of galvanized sheet metal, a curl or inwardly directed bend 42 is made along the exterior edge of the gutter. This bend provides an ideal anchor around which to position a spur 45 which depends from the bottom surface of the hanger base member 4 at a position intermediate the serrations and the first, or rear, end 5 of the base member. The spur 45 hooks around the bend 42 of the rain gutter to support the hanger and the attached light string. Since the profile of the outwardly facing, or exterior, side of a typical rain gutter usually tapers from a wide top opening to a narrower bottom surface the depending strap 14 of the hanger is molded to conform to the tapered profile of the exterior side surface of the rain gutter. Thus, the strap 14 lies flush against the outside facing surface of the rain gutter and the clamping jaws 18 and 20 are molded at such an angle to the inwardly leaning and depending strap that the jaws assume a position generally parallel to the ground to best maintain a firm grip on the wires 30.

I claim:

1. A hanger for electric wiring, comprising, an elongated base member having first and second ends and top and bottom surfaces and where at least a portion of at least one of either the top or bottom surfaces is serrated, a strap depending from the first end of the base member, and springable clamp means carried by the depending strap for securely holding at least one electrical conductor, and a curved spur depending from the base member intermediate its first and second ends and curving toward the depending strap.

2. The hanger of claim 1 where both the bottom and top surfaces of the base member are serrated and the serrations are disposed between the depending jaw means and the second end of the base member.

3. The hanger of claim 2 where the serrations comprise a plurality of tooth-like notches which point generally toward the first end of the base member.

4. The hanger of claim 3 where the depending strap is curvilinear to generally conform to the outside surface profile of a roof rain gutter.

5. The hanger of claim 4 where the clamp means comprises a pair of spaced apart and opposed springable jaws having inside surfaces adapted to grip one or more electrical conductors which are forced between the jaws.

6. The hanger of claim 5 where the springable jaws are generally parallel to the base member and have an open end between the jaws and a closed end where the jaws meet and first and second sides.

7. The hanger of claim 6 where the spacing between the jaws is greater on the first side than it is on the second side.

8. The hanger of claim 6 where at least one of the inside surfaces of the springable jaws is scalloped.

9. The hanger of claim 7 where at least one of the springable jaws comprises an extension of the depending strap.

* * * * *